US005445432A

United States Patent [19]

Chien

[11] Patent Number: 5,445,432

[45] Date of Patent: Aug. 29, 1995

[54] HEIGHT ADJUSTING MEANS FOR A CHAIR

[75] Inventor: Jui-Lung Chien, Taichung City, Taiwan

[73] Assignee: Jina Manufacturer Thai Co., Ltd., Thailand

[21] Appl. No.: 278,241

[22] Filed: Jul. 21, 1994

[51] Int. Cl.[6] ..... A47C 1/00; A47C 1/02; A47C 1/06

[52] U.S. Cl. ..... 297/344.18; 297/344.14; 297/344.12; 248/415; 248/188.5

[58] Field of Search ..... 297/344.18, 344.14, 297/344.12; 248/415, 188.5

[56] References Cited

U.S. PATENT DOCUMENTS

| | | | |
|---|---|---|---|
| 2,485,111 | 10/1949 | Robins | 297/344.18 |
| 2,637,371 | 5/1953 | Boutin | 297/344.18 |
| 5,165,755 | 11/1992 | Rho | 297/344.18 |
| 5,176,356 | 1/1993 | Lorbiecki et al. | 297/344.18 |
| 5,332,241 | 7/1974 | Rho | 297/344.14 |
| 5,348,374 | 9/1994 | Kuo | 297/344.18 |

*Primary Examiner*—Kenneth J. Dorner
*Assistant Examiner*—Anthony Barfield
*Attorney, Agent, or Firm*—Parkhurst, Wendel & Rossi

[57] ABSTRACT

A chair including a seat and a back, the back including a pair of parallel guide plates protruding from a rear surface thereof, each guide plate having a longitudinal groove. The seat and back are supported by first and second front legs and first and second rear legs, and a transverse part extends between the first and second front legs. The transverse part includes a top head portion including two guide tips respectively slidably received in the longitudinal grooves of the guide plates. Additionally, a height adjusting device is provided, including at least one casing slidably mounted on the first front leg, the casing including an operating element having a protrusion adapted to engage recesses formed in the first front leg of the chair.

3 Claims, 6 Drawing Sheets

HEIGHT ADJUSTING MEANS FOR A CHAIR

BACKGROUND OF THE INVENTION

The present invention relates to a height adjusting means and more particularly, to a height adjusting means for a chair designed for children and which needs only a simple action for height adjustment.

Height adjusting features are provided on many kinds of chairs, but most of them require a user to bow his body to rotate a certain adjusting element, a bolt with a large head for example, and this is a hard job for a regular user, and even more so for less able users.

The present invention intends to provide a height adjusting means which is operated only by pushing a link and which mitigates and/or obviates the above-mentioned problems.

SUMMARY OF THE INVENTION

The present invention provides a height adjusting means for a chair having a seat, a back, two front legs and two rear legs, the back is slidably engaged to the front legs on which an adjusting means is respectively engaged. The adjusting means has an operating element pivotally engaged therein and a protrusion extends therefrom, the front leg has a plurality of recesses defined therein such that a user who operates the operating element can insert the protrusion into a certain recess of the front leg to fix the seat at a desired position.

It is an object of the present invention to provide an easy operating adjusting means of a chair, which is slidably engaged to the front leg of the chair whose back is slidably engaged to the front leg such that to operate the adjusting means can decide the seat position corresponding to the front leg.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
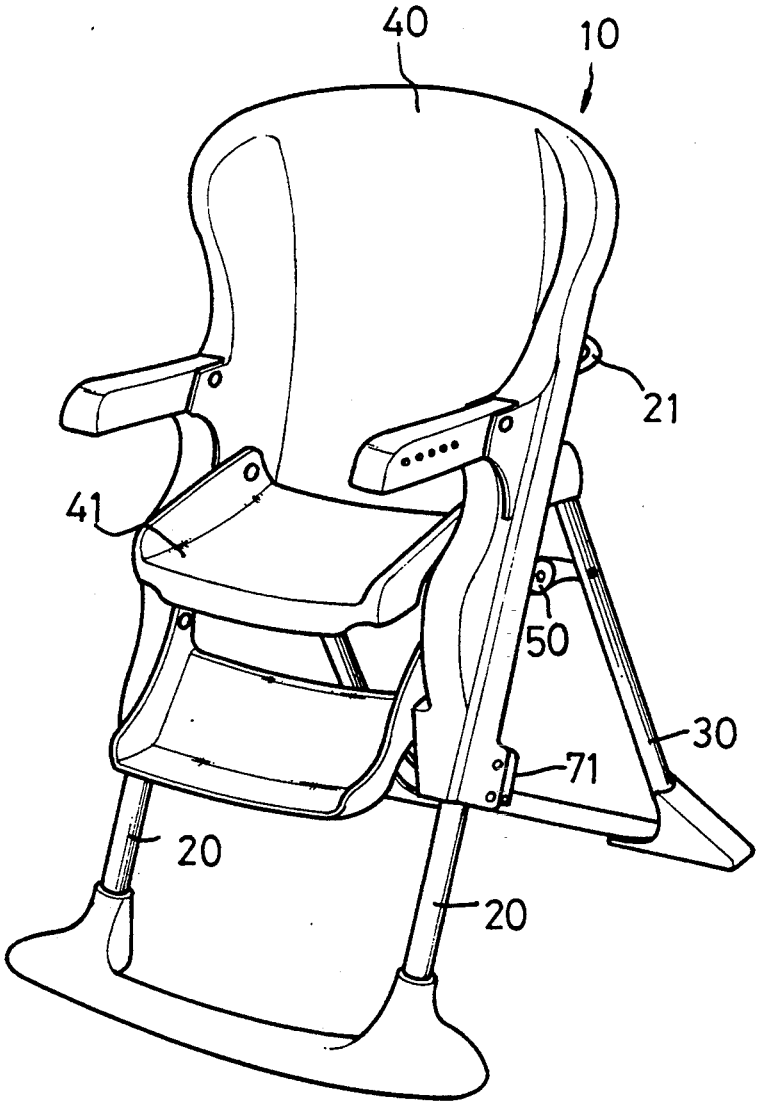
FIG. 1 is a perspective view of a chair comprising a seat, a back, two front legs and two rear legs, and an adjusting means in accordance with the present invention is disposed thereto.
Figure 2:
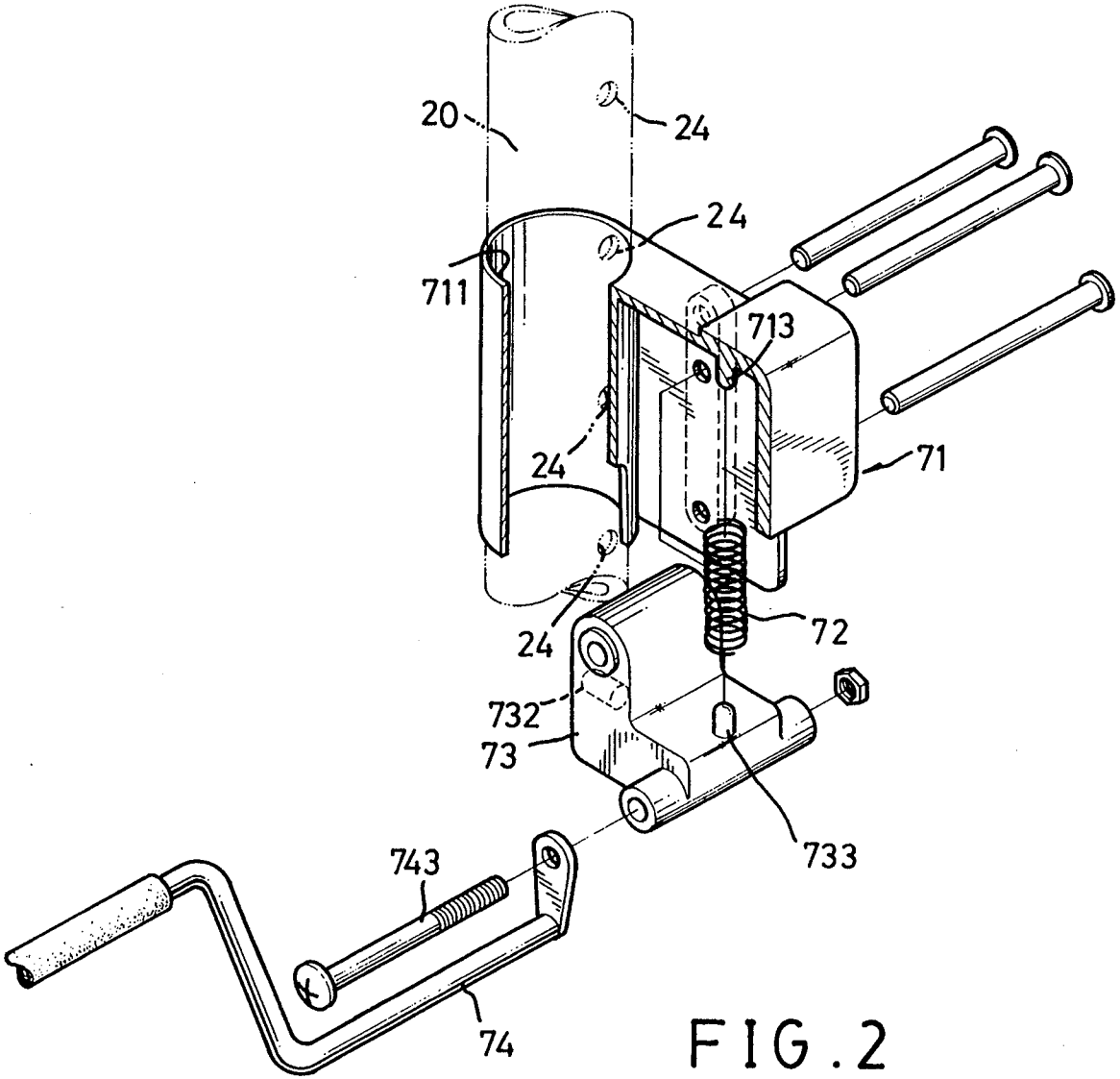
FIG. 2 is an exploded view, partly cut away, of the adjusting means in accordance with the present invention.
Figure 3:
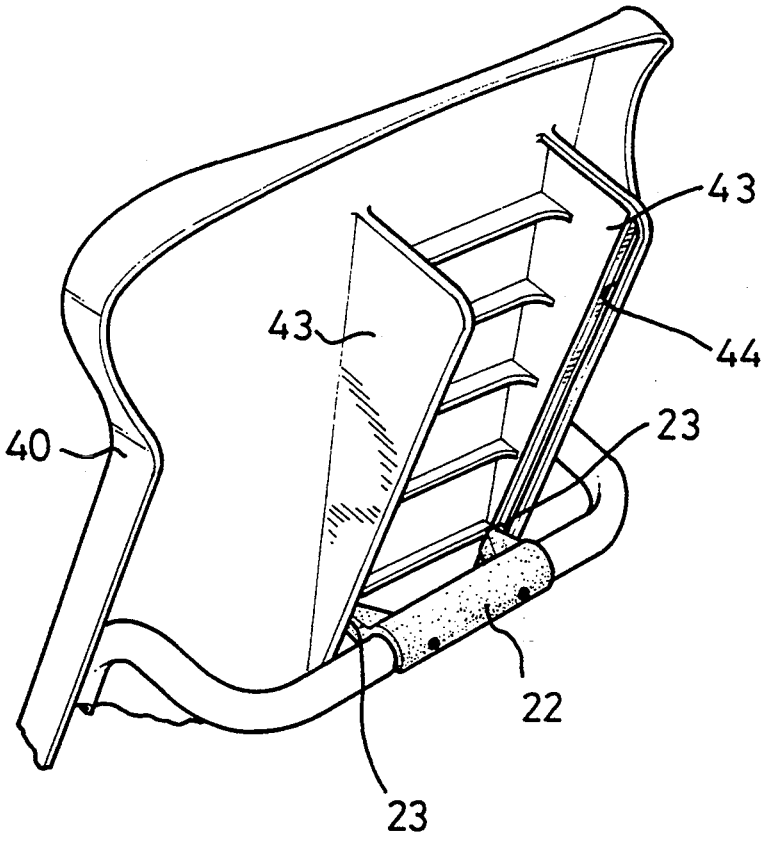
FIG. 3 is a perspective view of a rear side of the back of the chair showing two rails disposed thereto for receiving a top end of the front legs.

Referring to the drawings and initially to FIGS. 1, 2 and 3, a height adjusting means for a chair in accordance with the present invention is shown, wherein the chair 10 includes a seat 41, a back 40, two front legs 20 and two rear legs 30, the back 40 is slidably engaged between the front legs 20 and the rear legs 30 are slidably engaged to the front legs 20 by a middle socket element 301 (see FIG. 4) and a hinged plate 50 is pivotally connected between the front and the rear legs 20, 30. A top head 22 is disposed to a transverse part of the front legs 20 and has two tips 23 formed thereon. The back 40 has two plates 43 which are parallel with each other and extend outward from the rear side thereof and each has a groove 44 defined therein. The tips 23 of the top head 22 are received in the grooves 44 respectively such that the back 40 can be slid along the front legs 20 by the tips 23 sliding in the grooves 44 of the plates 43.

Figure 4:
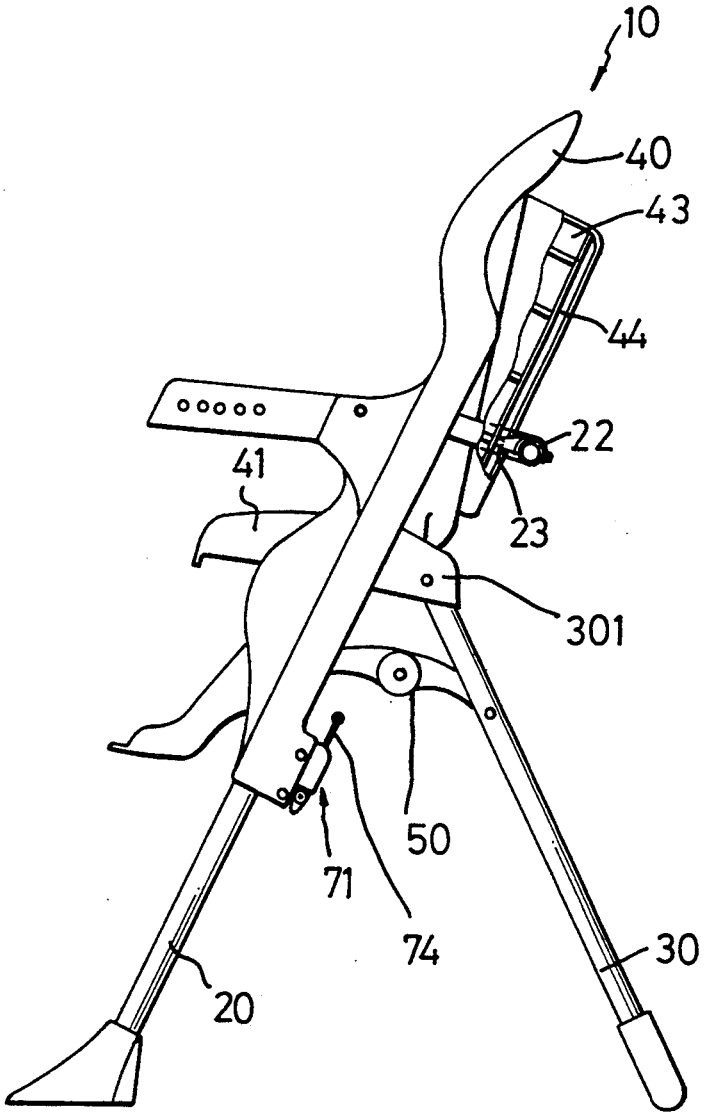
FIG. 4 is a side elevational view of the chair the seat of which is at a high position.
Figure 5:
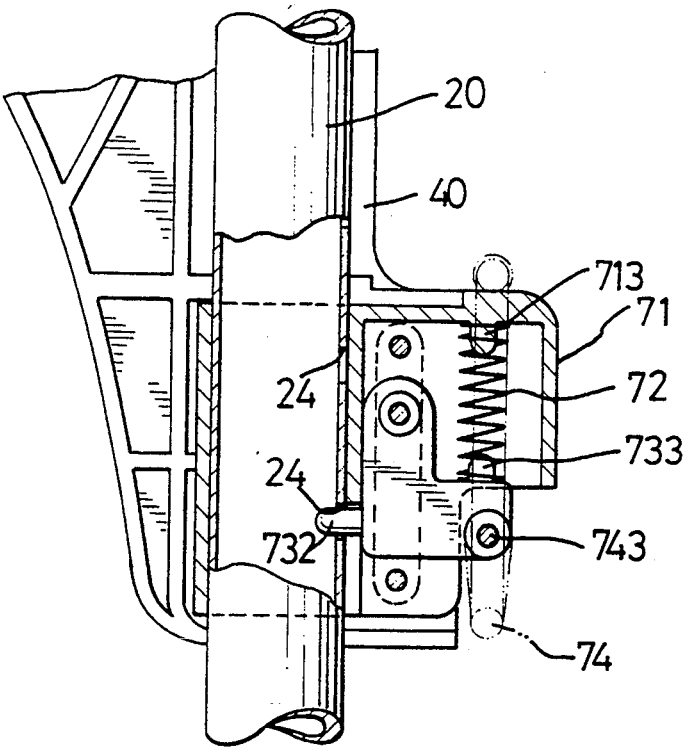
FIG. 5 is a side elevational view, partly in section, of the adjusting means in which a protrusion extending therefrom is inserted into a recess defined in the front leg.

Please refer to FIGS. 2, 4 and 5, the height adjusting means includes a casing 71, an operating element 73 and a spring 72. Each front leg 20 has the adjusting means disposed thereto. The casing 71 has a first end having a hole 711 defined therein for receiving the front leg 20 in which a plurality of recesses 24 are defined, and a second end having an opening defined in an under side thereof and the operating element 73 which is L-shaped, is pivotally engaged to the casing 71 in the opening by a top portion thereof. A protrusion 732 extends from the operating element 73 toward the recesses 24 of the front leg 20 and a projection 733 projects from a horizontal portion of the operating element 73 toward another projection 713 which projects from an under side of the casing 71 so as to engage the spring 72 therebetween. A rod 74 is connected between the two operating elements 73 disposed to the two front legs 20 by bolts 743.

Figure 6:
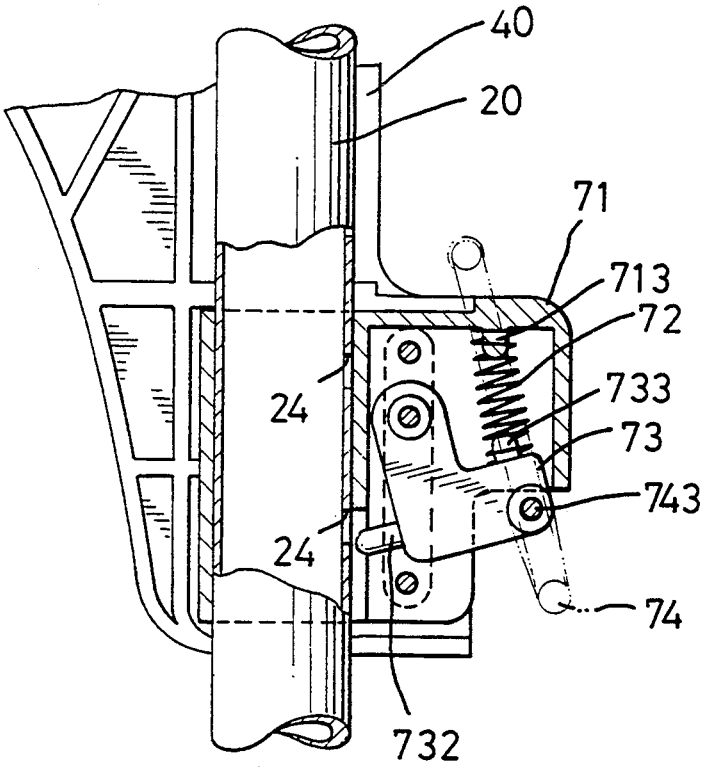
FIG. 6 is a side elevational view, partly in section, of the adjusting means in which the protrusion is disengaged from the recess of the front leg.
Figure 7:
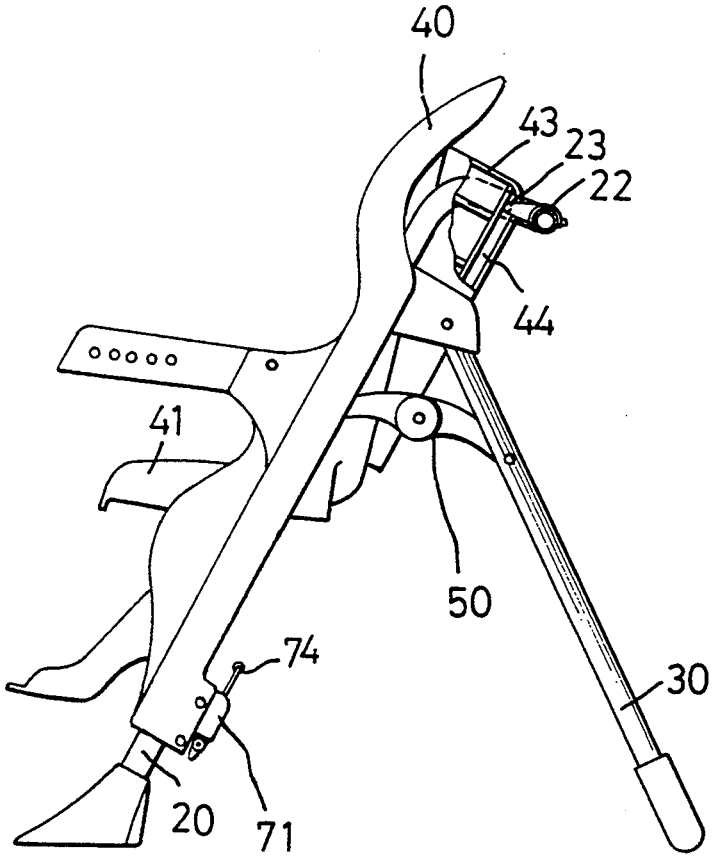
FIG. 7 is a side elevational view of the chair the seat of which is fixed at a lower position.

Referring now to FIGS. 6 and 7, the protrusion 732 is inserted in the recess 24 of the front leg 20 to fix the seat 41 in position. When adjusting the height of the seat, a user pushes the rod 74 downwardly and that causes the operating element 73 to rotate about the pivotal top portion thereof and thus disengages the protrusion 732 from the recess 24 of the front leg 20. In the meantime, the seat 41 can be lifted or lowered to another required position and then the rod 74 is released, the operating element 73 is then rotated back because of the spring 72 and the protrusion 732 is therefore inserted in a corresponding recess 24 to fix the seat 41 at a new position.

Although the invention has been explained in relation to its preferred embodiment, it is to be understood that many other possible modifications and variations can be made without departing from the spirit and scope of the invention as hereinafter claimed.

I claim:

1. A chair comprising:

a seat and a back, said back comprising a pair of parallel guide plates protruding from a rear surface thereof, each guide plate having a longitudinal groove;

first and second front legs and first and second rear legs for supporting the seat and back, said back being slidably mounted on said first and second front legs, at least said first front leg including a plurality of recesses;

a transverse part extending between the first and second front legs, said transverse part including a top head portion having two guide tips respectively slidably received in the longitudinal grooves in the guide plates; and height adjusting means for adjusting a height of the seat and back, comprising at least one casing slidably mounted on said first front leg, said casing having an operating element including a protrusion adapted to engage the recesses in said first front leg.

2. The chair of claim 1 wherein said operating element has a rod connected thereto which extends transversely.

3. The chair of claim 1 wherein said operating element has a spring disposed between an inner side of said casing and said operating element.

* * * * *